US006334463B1

(12) United States Patent
Lee

(10) Patent No.: US 6,334,463 B1
(45) Date of Patent: Jan. 1, 2002

(54) INNER PIPE FOR A FAUCET

(75) Inventor: Leon Lee, Taipei (TW)

(73) Assignee: Princeton International Company, Taipei (TW)

( * ) Notice: Subject to any disclaimer, the term of this patent is extended or adjusted under 35 U.S.C. 154(b) by 0 days.

(21) Appl. No.: 09/688,827

(22) Filed: Oct. 17, 2000

(51) Int. Cl.[7] ..... E03C 1/04

(52) U.S. Cl. ..... 137/801; 4/678; 137/360; 285/193

(58) Field of Search ..... 4/678; 137/360, 137/801; 285/193

(56) References Cited

U.S. PATENT DOCUMENTS 3,079,093 A * 2/1963 Bellows ..... 137/801 X
3,136,570 A * 6/1964 Lee ..... 137/360 X
3,739,806 A * 6/1973 Bucknell et al. ..... 137/360 X

* cited by examiner

*Primary Examiner*—Gerald A. Michalsky
(74) *Attorney, Agent, or Firm*—Rosenberg, Klein & Lee

(57) ABSTRACT

An inner pipe for a faucet with a retaining cut out includes a tubular body and a cap mountable on the body. A threaded first end is formed on the body to securely mate with a threaded socket formed in the faucet. A polygonal is formed on a second end of the body and includes a circumferential slit. The cap has a ring and a flange. The ring has a polygonal bore configured to mate with the tubular exterior and provide a limited rotational movement therebetween. The flange has a lug radially extending therefrom and configured to mate with the retaining cut out of the faucet. Two resilient elements are formed on the cap and each has a tooth to engage in the circumferential slit.

5 Claims, 8 Drawing Sheets

INNER PIPE FOR A FAUCET

BACKGROUND OF THE INVENTION

1. Field of the Invention

The present invention is related to an inner pipe for a faucet, and more particularly an inner pipe for a faucet which is convenient to fit between the faucet and a water supply pipe, whereby the faucet will not rotate in relation to a wall it abuts and water will not leak from corresponding joints.

2. Description of Related Art

Decorative faucets, especially bathroom faucets, comprise an attractive outer body and an inner pipe extending between a threaded socket of the outer body and a water supply pipe emerging from a wall. Referring to FIGS. 6, 7 and 8, a prior art inner pipe (52) for a decorative faucet (50) is shown. The faucet (50) includes a hollow body (502) with an inlet end (504), a neck and an outlet end (506), a threaded socket (507) formed in the neck and defining a passage extending between the inlet and outlet ends (504, 506) and a gasket (508) received at a bottom face of the socket (507). A recess (509) is defined in an end face of the inlet end (504). The inner pipe (52) comprises a first end with a male thread (522), a second end with a flange (524), a bore leading to the first end, and a threaded counter bore leading to the second end. The flange (524) has a resilient lug (526) extending radially therefrom. In assembly, the male thread (522) of the inner pipe (52) is mated with the socket (507) until the gasket (508) is compressed by an end face of the first end of the inner pipe (52), whereby a water-tight seal should be achieved therebetween. Then, the combined faucet (50) and pipe (52) are mounted to a water supply pipe (54) with a male thread of the water supply pipe (54) being mated with the counter bore until the resilent lug (526) can be snappingly received in the recess (509), whereby the faucet (50) should not be able to rotate relative to the water supply pipe (54). However, the following shortcomings are found with the prior art inner pipe (52) and faucet (50). The threading of the socket (507) has to be cut very precisely to ensure that when the inner pipe (52) is fitted to the faucet (50), both an appropriate distance between the end face of the inlet end (504) of the faucet (50) and the wall, and alignment between the lug (526) and the recess (509) are achieved. In practice, such achievements are not realized, and as shown in FIG. 8, water leaks from the neck due to the gasket (508) not being sufficiently compressed, and an ugly gap is formed between the inlet end (504) of the faucet (50) and the wall. That gap detracts from the decorative appearance of the faucet (50), and also provides an exit for leaking water, whereby that water dribbles down the wall. Furthermore, as shown in FIG. 8, the lug (526) is not received in the recess (509) due to an incorrect length of the male thread (522).

Thus there is a long and unfulfilled need for an inner pipe for a faucet which provides a conveniently-arranged water tight seal, and fine adjustment of a distance between an inlet end face of the faucet and a wall from which a water supply pipe emerges.

SUMMARY OF THE INVENTION

An objective of the present invention is to provide an inner pipe for a faucet with which a conveniently-arranged water tight seal with the faucet is achieved.

A further objective of the present invention is to provide an inner pipe for a faucet with which fine adjustment of a distance between an inlet end face of the faucet and a wall from which a water supply pipe emerges is achieved.

The inner pipe includes a tube with a first end having a male thread formed thereon, and a second end with a polygonal outer periphery formed thereon, and a flanged end cap with a polygonal inner periphery configured to retainably mate with the second end of the tube. The flanged cap further includes a resilient lug radially extending therefrom.

Other objects, advantages and novel features of the invention will become more apparent from the following detailed description when taken in conjunction with the accompanying drawings.

DETAILED DESCRIPTION OF THE PREFERRED EMBODIMENT

Figure 1:
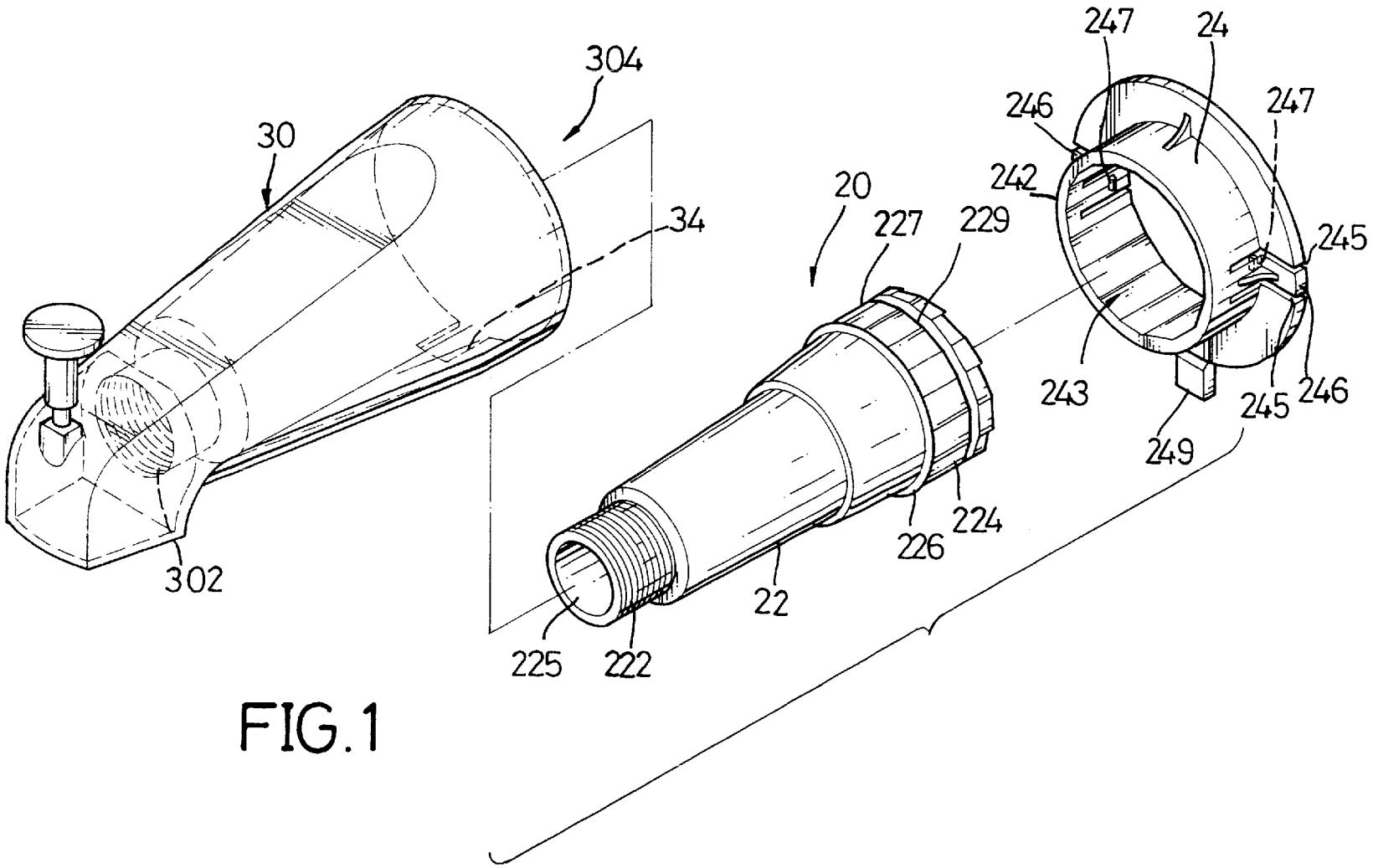
FIG. 1 is an exploded view of a first embodiment of an inner pipe for a faucet, in accordance with the present invention.
Figure 2:
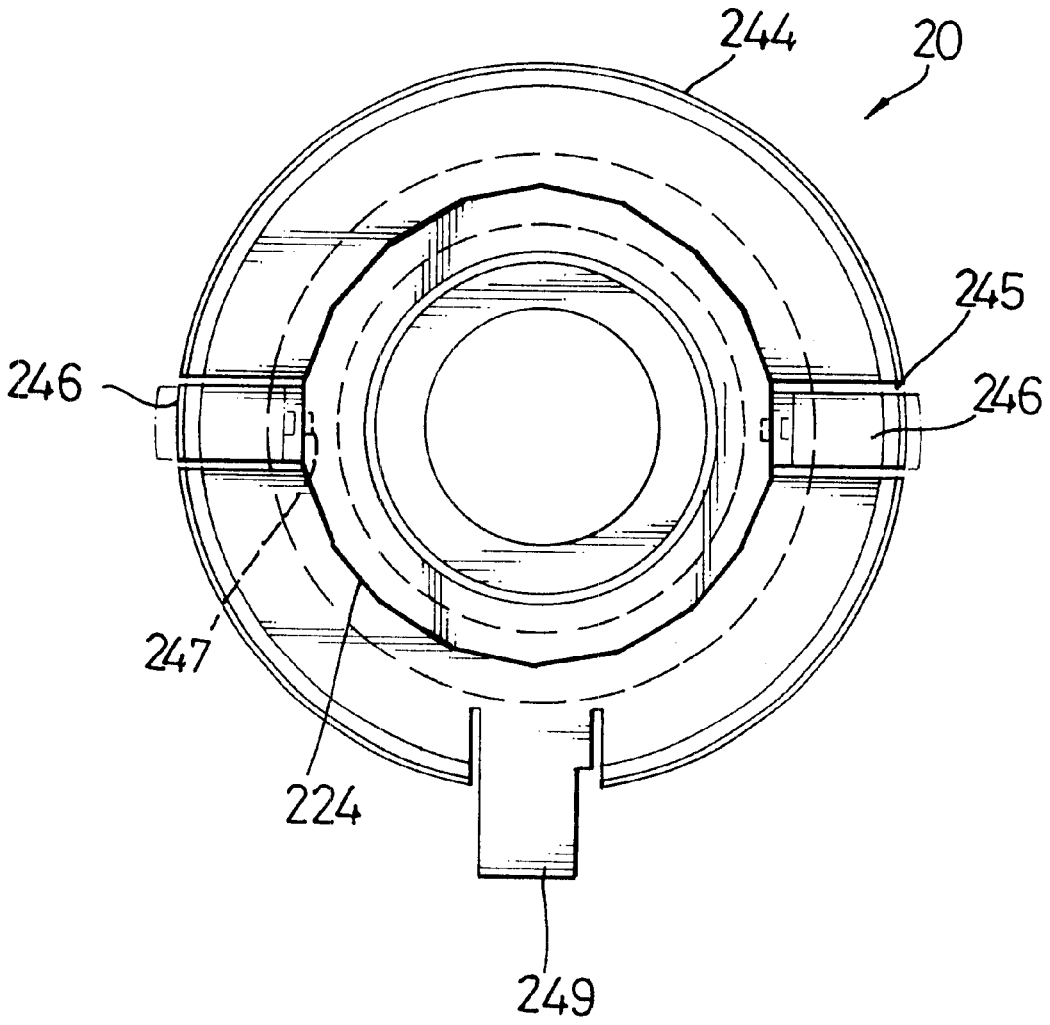
FIG. 2 is an end view of the inner pipe shown in FIG. 1.
Figure 3:
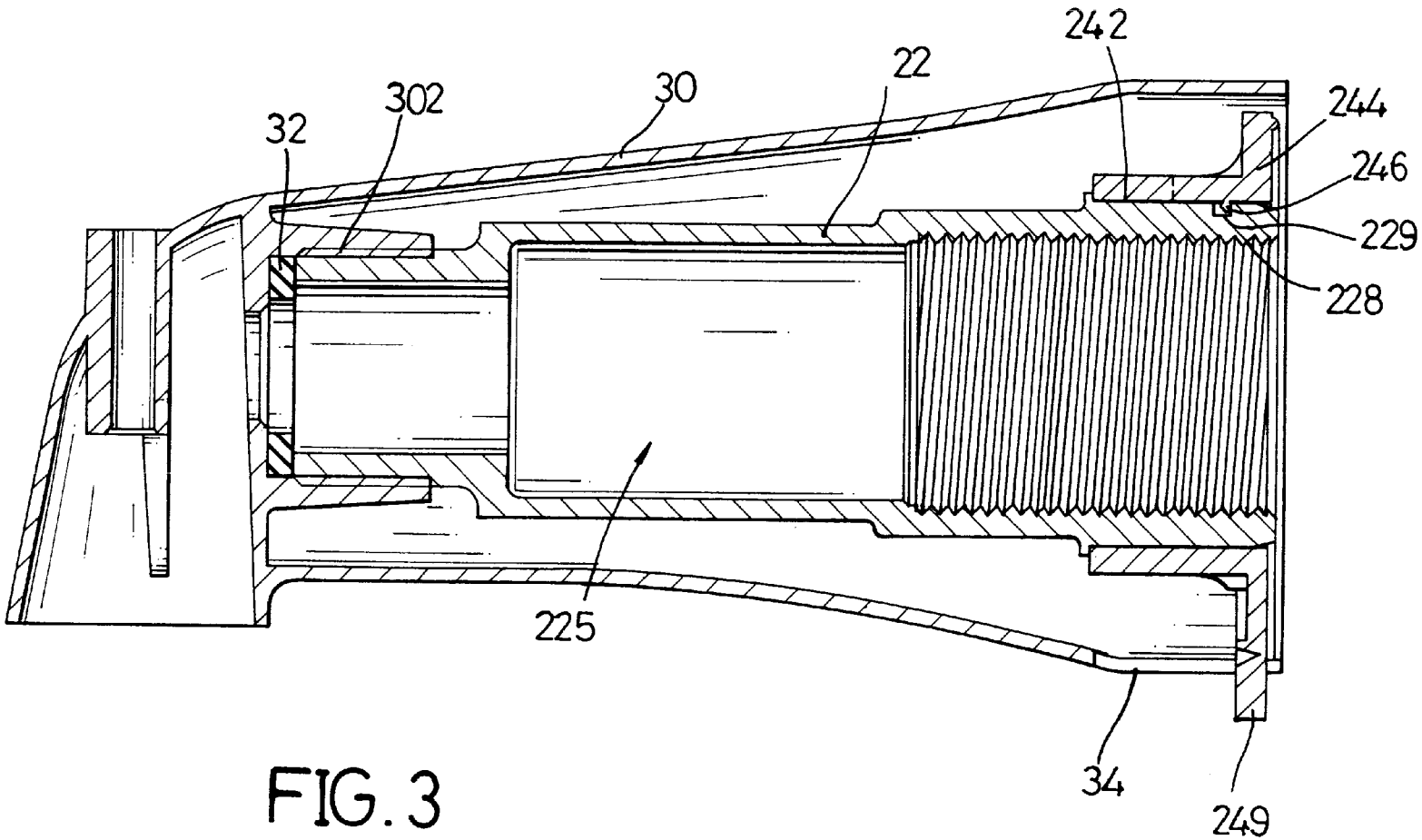
FIG. 3 is a cross sectional view of the inner pipe of FIG. 1, fitted in a faucet.

As shown in the figures and in particular FIGS. 1 and 2, an inner pipe (20) for a faucet (30) includes a tubular body (22) with a first end formed as a male thread (222), a second end formed as a polygonal exterior (224), and a passage (225) extending between the first and second ends, and a cap (24) with a ring (242) and a flange (244). The male thread (222) is sized to threadingly engage with a female threaded socket (302) formed near a first end of a recess (304) defined in the faucet (30), as additionally shown in FIG. 3. The polygonal exterior (224) is preferably formed with eighteen sides and has a first end formed with a circumferential ridge (226), a central portion (227), a second end defining a threaded entrance (228), to the passage (225) as seen in FIG. 3, and a circumferential slit (229) close to the second end. The ring (242) of the cap (24) includes a bore (243) with a polygonal periphery configured to mate with the exterior (224) of the tubular body (22), that is, in this preferred embodiment it has eighteen sides and a length substantially equal to a distance from the second end of the polygonal exterior (224) to a junction between the circumferential ridge (226) and the central portion (227). Two pairs of slits (245) are opposedly defined in the cap (24) and extend along the flange (244) and partly along the ring (242), whereby two resilient portions (246) are formed in the cap (24). Each resilient portion (246) has a tooth (247) formed on an inner periphery defining the bore (243), and a distance between distal faces of the teeth (247) is smaller than a minimum diameter of the tubular body (22). The teeth (247) are dimensioned to be slidingly received in the circumferential slit (229) when the cap (24) is mounted over the tubular body (22). The cap (24) further has a resilient lug (249) extending radially from a circumference of the flange (244).

Figure 4:
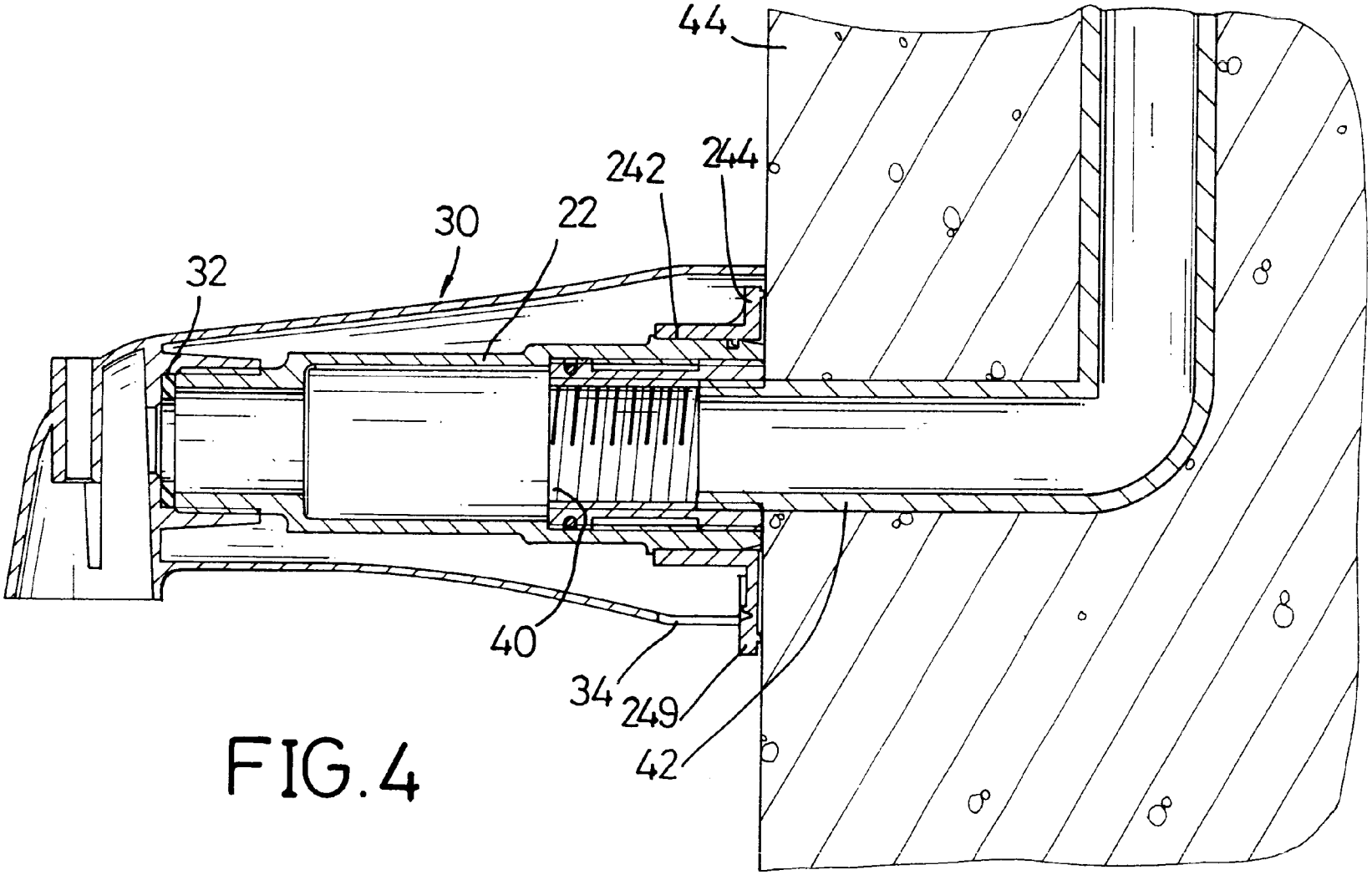
FIG. 4 is a cross-sectional view of the inner pipe of FIG. 1, fitted between a faucet and a water supply pipe of a wall.

In assembly, referring to FIGS. 3 and 4, a gasket (32) is fitted in the socket (302) of the faucet (30), whereafter the tubular body (22) is fitted to the faucet (30) via the male thread (22) being tightly engaged with the female thread (302) to compress the gasket (32), thereby providing a watertight joint between the faucet (30) and the first end of the tubular body (22). Then, the bore (243) of the cap (24) is mated with the second end of the tubular body (22) such that the lug (249) is aligned with a cut out (34) defined in a second end of the recess (304), whereafter the ring (242) slides over the polygonal exterior (224) and the resilient portions (248) are urged outward until an end face of the ring (242) abuts the circumferential ridge (226) and the teeth slide into the circumferential slit (229) due to tension in the resilient portions (248). Next, a copper pipe (40) with an external thread is securely screwed into the threaded opening (228) of the tubular body (22). The copper pipe (40) is securely mounted over a water supply pipe (42) protruding from a wall (44). Slight gaps between the eighteen sides of the polygonal exterior (224) of the tubular body (22) and the eighteen sides of the polygonal periphery bore (243) of the cap (24) allow a maximum axial rotation of twenty degrees of the faucet (30) in relation to the wall (44), and that amount of rotation is found to be sufficient for minor adjustment of the faucet (30).

To remove the cap (24) from the tubular body (22), the resilient portions (246) are pressed away from the bore (243), whereby the teeth (247) disengage from the circumferential slit (229) and the cap (24) is pulled away from the circumferential ridge (226) until it leaves the tubular body (22).

Figure 5:
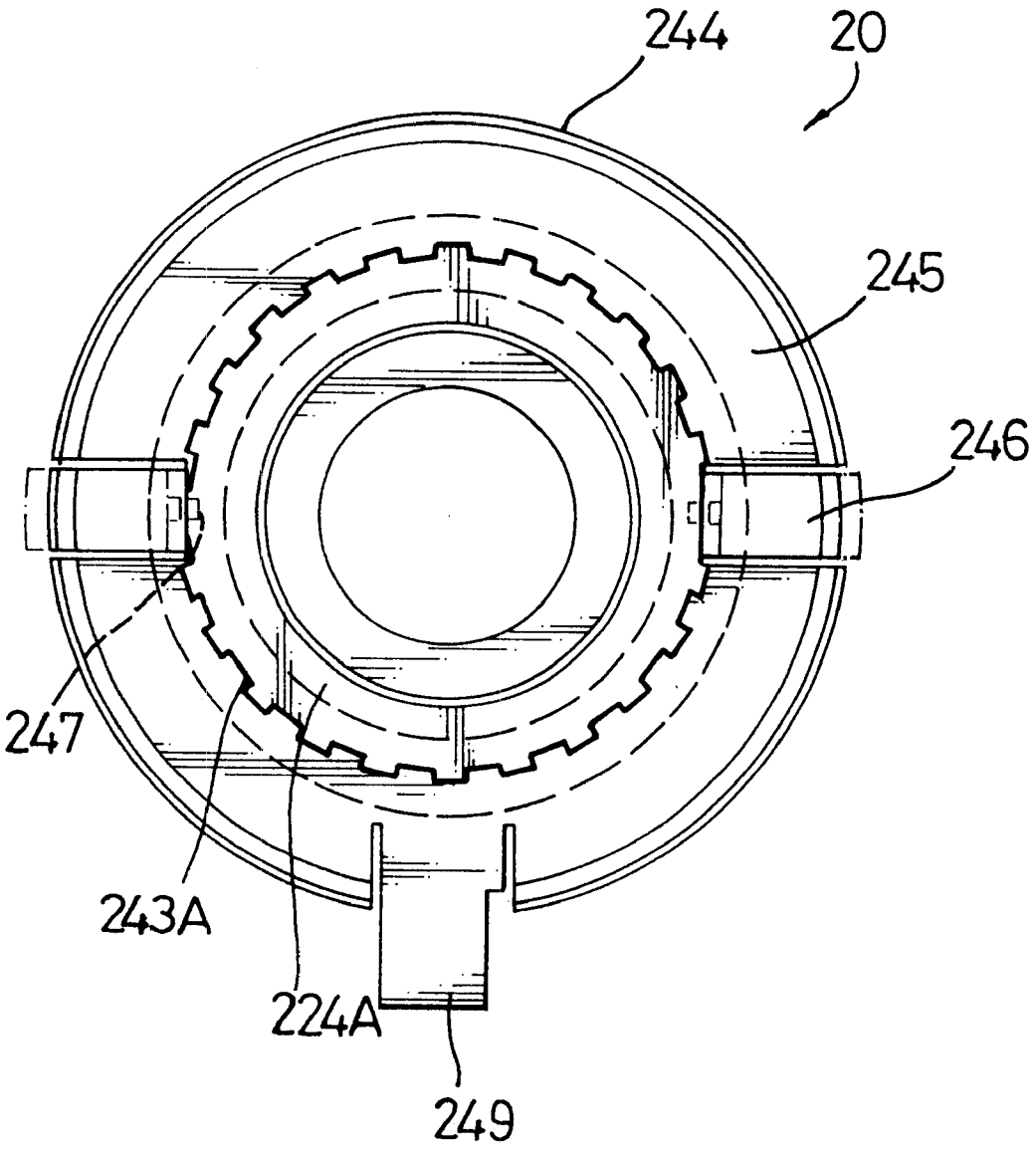
FIG. 5 is an end view of a second embodiment of the inner pipe of the present invention.
Figure 6:
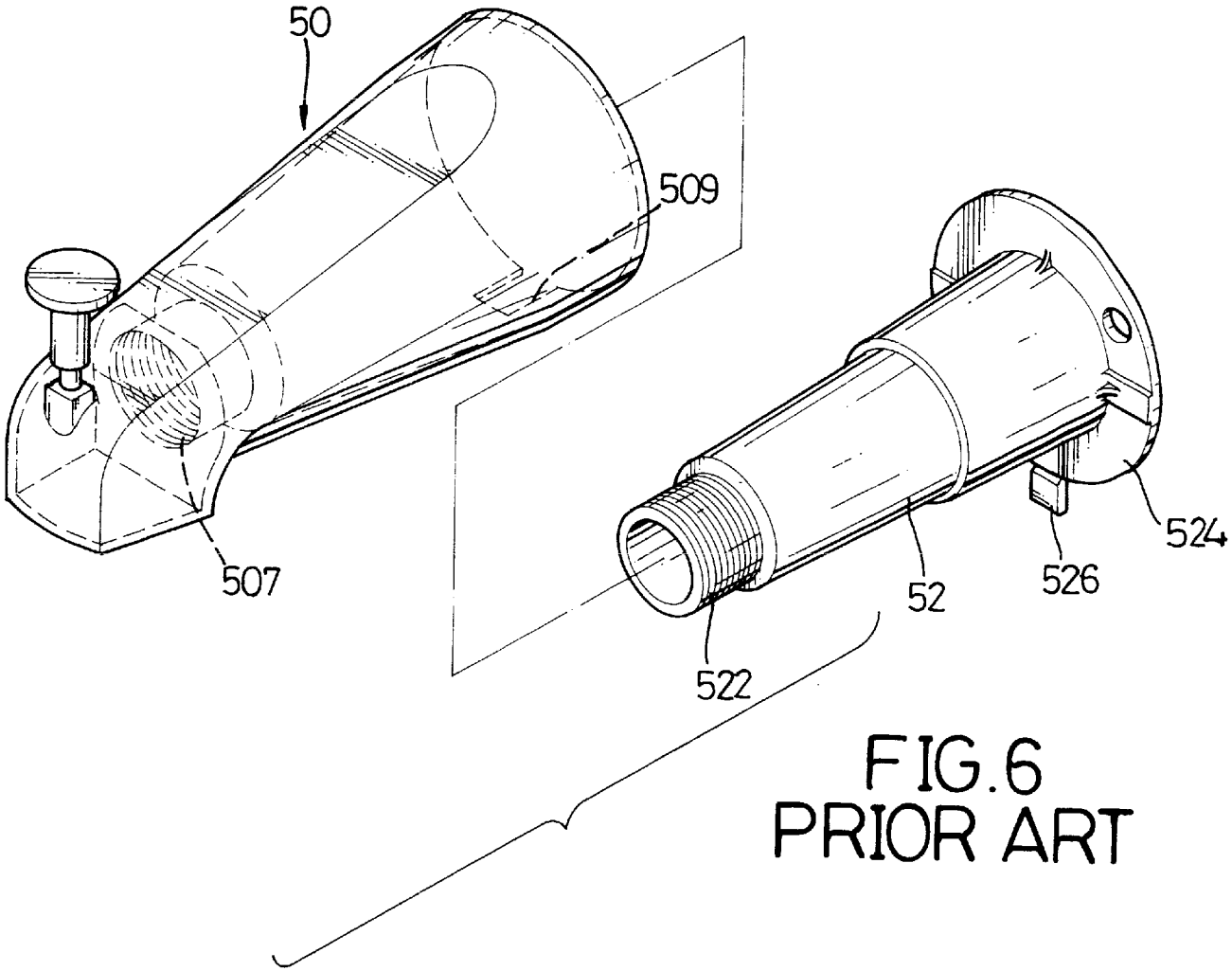
FIG. 6 PRIOR ART
FIG. 6 is an exploded view of a prior art inner pipe and faucet.
Figure 7:
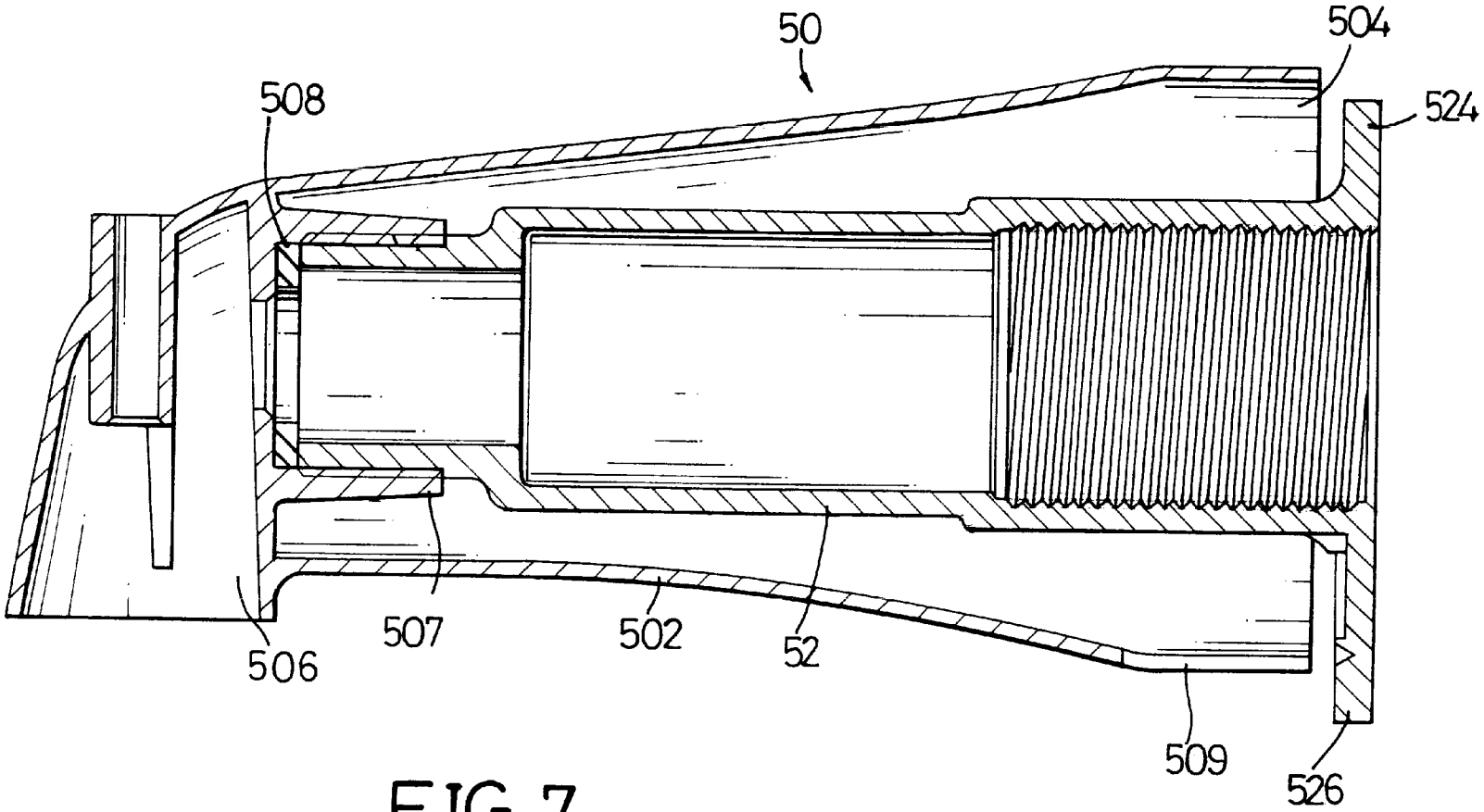
FIG. 7 PRIOR ART
FIG. 7 is a cross-sectional view of the prior art inner pipe fitted in the faucet of FIG. 6.
Figure 8:
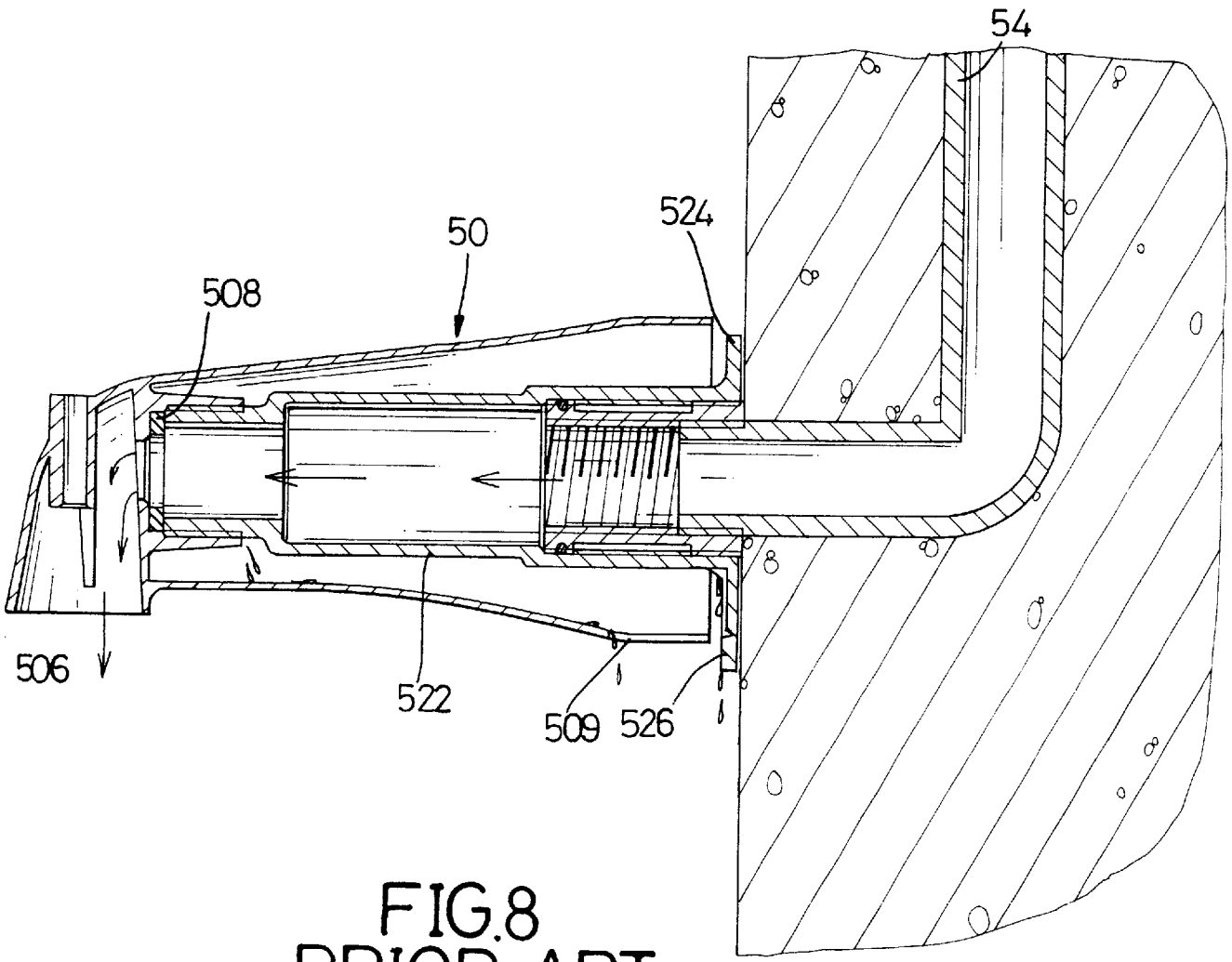
FIG.8 PRIOR ART
FIG. 8 is a cross-sectional view of the prior art inner pipe of FIG. 6, fitted between the faucet and a water supply pipe of a wall.

Referring to FIG. 5, a second embodiment of the invention is identical to the first embodiment other than the polygonal exterior (224) is replaced with a toothed exterior (224A) and the polygonal periphery bore (243) is replaced by a periphery (243A) configured to mate with the toothed exterior (224A) in the same manner as in the first embodiment, ie, a limited degree of rotational movement is allowed.

The inner pipe for a faucet in accordance with the present invention has the following advantages:

1. The male thread (222) of the tubular body can be tightly engaged with the gasket (32) and socket (302) of the faucet (30) whereby a watertight joint is confidently achieved.

2. The polygonal sides of the bore (243) and the exterior (224) allow fine adjustment of the faucet (30).

3. The removability of the cap (24) from the tubular body (22) allows good alignment of the lug (249) with the cutout (34) of the faucet (30).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An inner pipe for a faucet with a retaining cutout, fitted between a gasket in a threaded socket formed in a recess of the faucet and a threaded end of a water supply pipe, comprising:

a tubular body with a first end, a second end, and a passage extending between the first and second ends, the first end having an exterior thread configured to mate with the threaded socket of the faucet, and the second end having a polygonal exterior, and a threaded interior communicating with the passage and configured to mate with the threaded end of the water supply pipe, the polygonal exterior comprising a circumferential slit near a distal face of the second end, and a circumferential ridge formed at an end opposed to the distal face; and a cap having a ring, a flange and two resilient retaining elements formed in the flange and the ring, the ring defining a polygonal bore configured to mate with the polygonal exterior of the tubular body, the flange including a lug extending radially therefrom and configured to be receivable in the retaining cut out of the faucet, herein the cap is removably securable with the tubular body such that limited rotational movement between the polygonal exterior and polygonal bore allows fine adjustment of the faucet relative to the water supply pipe.

2. The inner pipe for a faucet as claimed in claim 1, wherein the resilient elements each have a tooth extending into the polygonal bore and sized to be receivable in the circumferential slit of the tubular body.

3. The inner pipe for a faucet as claimed in claim 1, wherein the polygonal bore d the polygonal exterior each have eighteen sides.

4. The inner pipe for a faucet as claimed in claim 1, wherein a distance from a junction between the circumferential ridge and the distal face of the polygonal exterior is equal to length of the polygonal bore.

5. The inner pipe for a faucet as claimed in claim 1, wherein the polygonal exterior has teeth and the polygonal bore is configured to mate with the teeth.

* * * * *